US006906672B1

(12) United States Patent
Miller et al.

(10) Patent No.: US 6,906,672 B1
(45) Date of Patent: Jun. 14, 2005

(54) PLANAR ANTENNA ARRANGEMENT

(75) Inventors: Paul E. Miller, Spring Lake, MI (US); Paul A. Bogdans, Grand Haven, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 0 days.

(21) Appl. No.: 10/604,496

(22) Filed: Jul. 25, 2003

(51) Int. Cl.[7] ..... H01Q 11/12
(52) U.S. Cl. ..... 343/744
(58) Field of Search ..... 343/860, 900, 343/713, 858, 741, 742, 743, 744, 745; 333/129, 132

(56) References Cited

U.S. PATENT DOCUMENTS 3,611,388 A 10/1971 Okumura
4,821,040 A 4/1989 Johnson et al.
5,402,134 A * 3/1995 Miller et al. ..... 343/742
5,508,710 A * 4/1996 Wang et al. ..... 343/726
6,204,817 B1 * 3/2001 Edvardsson ..... 343/702
6,297,711 B1 * 10/2001 Seward et al. ..... 333/129
2001/0010506 A1 * 8/2001 Taniguchi et al. ..... 343/712

* cited by examiner

*Primary Examiner*—Don Wong
*Assistant Examiner*—Minh Dieu A
(74) *Attorney, Agent, or Firm*—McGarry Bair PC

(57) ABSTRACT

An antenna arrangement for use over a metallic surface in motor vehicles is adapted to improve reception in the AM frequency range. An FM loop includes two conductor sections separated by a capacitor. An AM probe extends from one of the conductor sections near an antenna feed line connector and isolates AM signals by an L-C circuit between the probe and the connection to the conductor section. Omnidirectional reception is achieved by a coplanar WB probe, FM probe and AM coiled loop between them, mounted to a substrate.

25 Claims, 5 Drawing Sheets

PLANAR ANTENNA ARRANGEMENT

BACKGROUND OF INVENTION

1. Field of the Invention

The invention relates to antenna arrangements for installation under dielectric covers, and more particularly to antennas for use in motor vehicle structures.

2. Description of the Related Art

It is common for motor vehicles such as cars, trucks, tractors, recreational vehicles and the like to use several antennas for such purposes as cellular telephones, CB, global positioning system (GPS), weatherband (WB), and the standard AM/FM radio. This proliferation of antennas is attended by special problems such as finding an appropriate mounting position for non-interfering operation as well as such inconveniences as high-speed antenna noise or "whistle." Attempts have been made in the prior art to avoid external antennas and incorporate them into windowpanes and roof panels and the like.

Non-conducting materials such as fiberglass are now commonly used particularly in the construction of truck cabs in order to save weight. However, the use of such a dielectric material presents a problem for antenna designers, since most antennas require a ground plane provided by the metallic vehicle body for efficient operation. One solution to this problem is provided in U.S. Pat. No. 5,402,134 where a flat plate antenna module is disclosed. The module comprises one or more antenna loops formed from thin conductor strips arranged on a dielectric substrate. The substrate readily fits between the headliner of a truck cab and a nonconductive roof panel.

The solution in the '134 patent works well over a nonconductive surface, but there is a noticeable degrading of performance in applications were the antenna module is disposed over a conductive surface, such as in a tractor where the headliner is strengthened with metal. Also, the manufacture of antenna modules with conductive ink is expensive.

Another common solution, especially for vehicles using the common AM/FM and WB frequencies is providing three receiving wires of different lengths laid horizontally parallel or flared from a single attachment point. The AM receiving wire would typically be 105 inches long, the FM 30 inches, and the WB 16 inches. These lengths are normally effective to render the wires (at least for FM and WB) about a quarter wavelength at midband. But such an antenna arrangement proves to be highly directional and subject to other noise generating sources that may be nearby, including wiring harnesses, etc.

SUMMARY OF INVENTION

These and other problems of the prior art are overcome in accordance with this invention of an antenna arrangement comprising a first loop having first and second conductor sections of substantially equal length, and a capacitor. Each conductor section has an antenna feed line connector on one end, and the other end is connected to one side of the capacitor. The length of the first and second conductor sections is sufficient to resonate in the FM frequency range. The capacitor has a predetermined value of capacitance to block frequencies in the AM range.

A probe, coplanar with the first loop, is connected to the first section, and has sufficient length to effectively function as a dipole AM antenna. Preferably, an L-C circuit is mounted between the probe and the first section to isolate AM loading from the first loop.

In one embodiment of the invention, the first loop is square, and both the loop and the probe are formed of multiple segments. Typically, the segments are normal to each other. Ideally, the probe comprises four segments, and each of the segments is parallel to a conductor section.

In another aspect of the invention, a second probe is coplanar with the first loop, connected to the first section and has a length sufficient to resonate at the weatherband frequency. An L-C circuit can be disposed between the second probe and the first section.

Preferably the probe and/or the second probe are connected to the first section near the antenna feed line connector, although connection to the first section near the capacitor is equally possible.

Another aspect of the invention has an antenna module comprising a planar dielectric substrate. A first loop is mounted to the substrate and has first and second conductor sections of substantially equal length, and a capacitor. Each conductor section has one end with an antenna feed line connector and the other end connected to one side of the capacitor. The length of the first and second conductor sections is sufficient to resonate in the FM frequency range and the capacitor has a predetermined value of capacitance to block frequencies in the AM range. A probe is mounted to the substrate substantially coplanar with the first loop, connected to the first section, and having sufficient length to effectively function as a dipole AM antenna.

In a further aspect of the invention, an antenna module comprises a planar dielectric substrate, a first probe mounted to the substrate, a second probe mounted to the substrate normal to and shorter than the first probe; and a loop mounted to the substrate coplanar with the first and second probes, and within the angle formed between the first and second probes. The first and second probes and the loop are each connected to a single feed point and the loop comprises multiple turns, no turn extending beyond the length of either the first or second probes.

Preferably, each turn of the loop and the first and second probes are equidistantly spaced from each other. The antenna arrangement can further have a ground lead connected to the feed point.

Typically, the first probe has sufficient length to resonate in the FM frequency range, the second probe has sufficient length to resonate in the WB frequency range and the loop has sufficient length to effectively function as an AM antenna. Because of the interaction among them, the length of each of the probes and the loop is less than one quarter wavelength of its corresponding frequency midrange.

DETAILED DESCRIPTION

Figure 1:
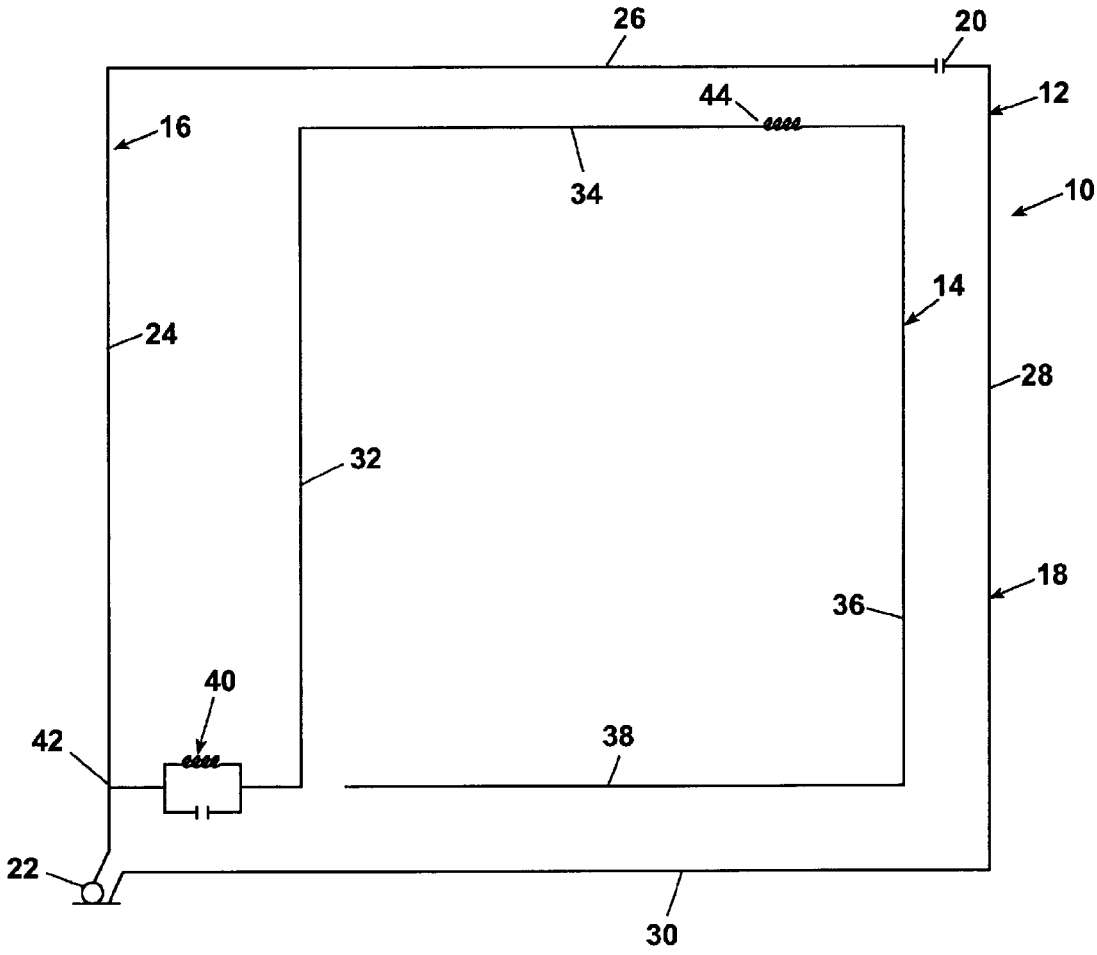
FIG. 1 is a plan schematic view of an antenna arrangement according to the invention.

A flat antenna arrangement 10 according to the invention is illustrated in FIG. 1. The arrangement 10 comprises an FM loop 12 and an AM probe 14. The FM loop 12 has two separate conductor sections 16, 18, together forming a square loop having a total length of approximately one wavelength in the FM frequency range. A capacitor 20 is connected between the two conductor sections 16, 18, preferably in one corner of the square loop 12. Diametrically opposite the capacitor 20 on the square loop 12 is a feed point 22 that is adapted to connect to an antenna feed line (not shown) in the conventional manner.

The capacitor 20 may be a discrete capacitor, preferably having a typical value of 50 Pico farads. Ideally, the capacitor will have a value such that the capacitor 20 presents essentially a low impedance connection at the FM frequency, and a substantial impedance in the AM frequency range.

The conductor section 16 has portions 24, 26 extending at right angles to each other between the feed point 22 and the capacitor 20. In a similar manner the conductor section 18 has portions 28 and 30 extending at right angles to each other past the capacitor 20. With each portion 24, 26, 28 and 30 being approximately 32 inches long, and the capacitor 20 having a value at about 50 Pico farads, the whole square FM loop 12 will resonate in the FM band (from 88 to 108 MHz).

The position and value of the capacitor 20 effectively makes the conductor sections 16, 18 into the equivalent of two legs of an AM antenna. It has been found that when the foregoing structure is placed over a conductive surface, the performance of the antenna module in AM reception is significantly degraded. In accordance with the invention, the AM probe 14 is connected to the portion 24 near the feed point 22 to enhance AM reception, even over a conductive plane. The AM probe 14 comprises four segments 32, 34, 36, and 38 disposed inside the square loop 12, and coplanar with it, with each segment being respectively parallel to the portions 24, 26, 28, and 30. The AM probe 14 is isolated from the square FM loop 12 by a resonant L-C circuit 40 connecting an end of the segment 32 to a feed point 42 near the feed point 22 of the FM loop 12. The circuit 40 is preferably self-resonant at about 100 MHz to prevent the AM probe 14 from loading the FM loop 12. A coil 44 can optionally be added between the segments 34 and 36 to electrically lengthen the AM probe 14 and further enhance AM reception.

Figure 2:
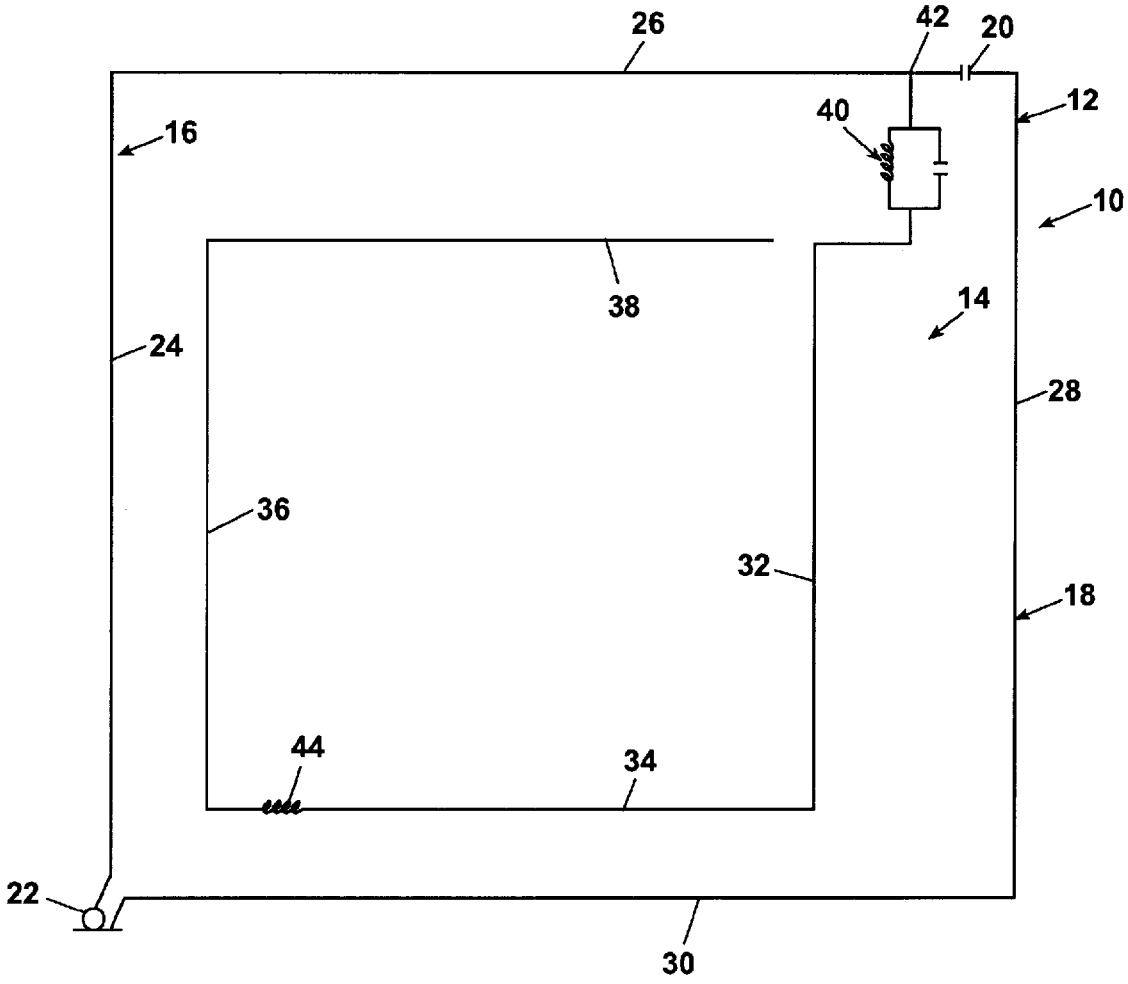
FIG. 2 is a plan schematic view of an alternate construction of the antenna arrangement of FIG. 1.

It will be understood that while the FM loop 12 and the AM probe 14 are illustrated in FIG. 1 as essentially square, the relative configurations can be circular, provided that the relative circumferences are selected to resonate at the appropriate frequency range. An alternative arrangement is illustrated in FIG. 2 where like components are identified with like numerals. It will be seen that the only difference between the configuration of FIG. 2 and the configuration of FIG. 1 is the location of the feed point 42 where the AM probe 14 connects to the FM loop 12. In FIG. 2, the feed point 42 is located nearer to the capacitor 20 than to the feed point 22.

The actual construction of an arrangement 10 in accordance with the invention can take many different forms. Typically the feed point 22 will be adapted to connect to a high impedance cable (normally RG 62). With respect to the arrangement 10 itself, it is important only that the FM loop 12 and the AM probe 14 be coplanar. The FM loop 12 and the AM probe 14 can be formed of single wires mounted and held in place so as to be coplanar. Alternatively, the arrangement 10 can be formed of wires or conductive ink on a dielectric substrate to form a module. It is possible to the weave wires into a web, or to sew wires onto a dielectric substrate. A preferred and low-cost construction is to use a corrugated polypropylene substrate for some rigidity, and affix to it an arrangement 10 such as that illustrated in FIGS. 1–2.

Figure 3:
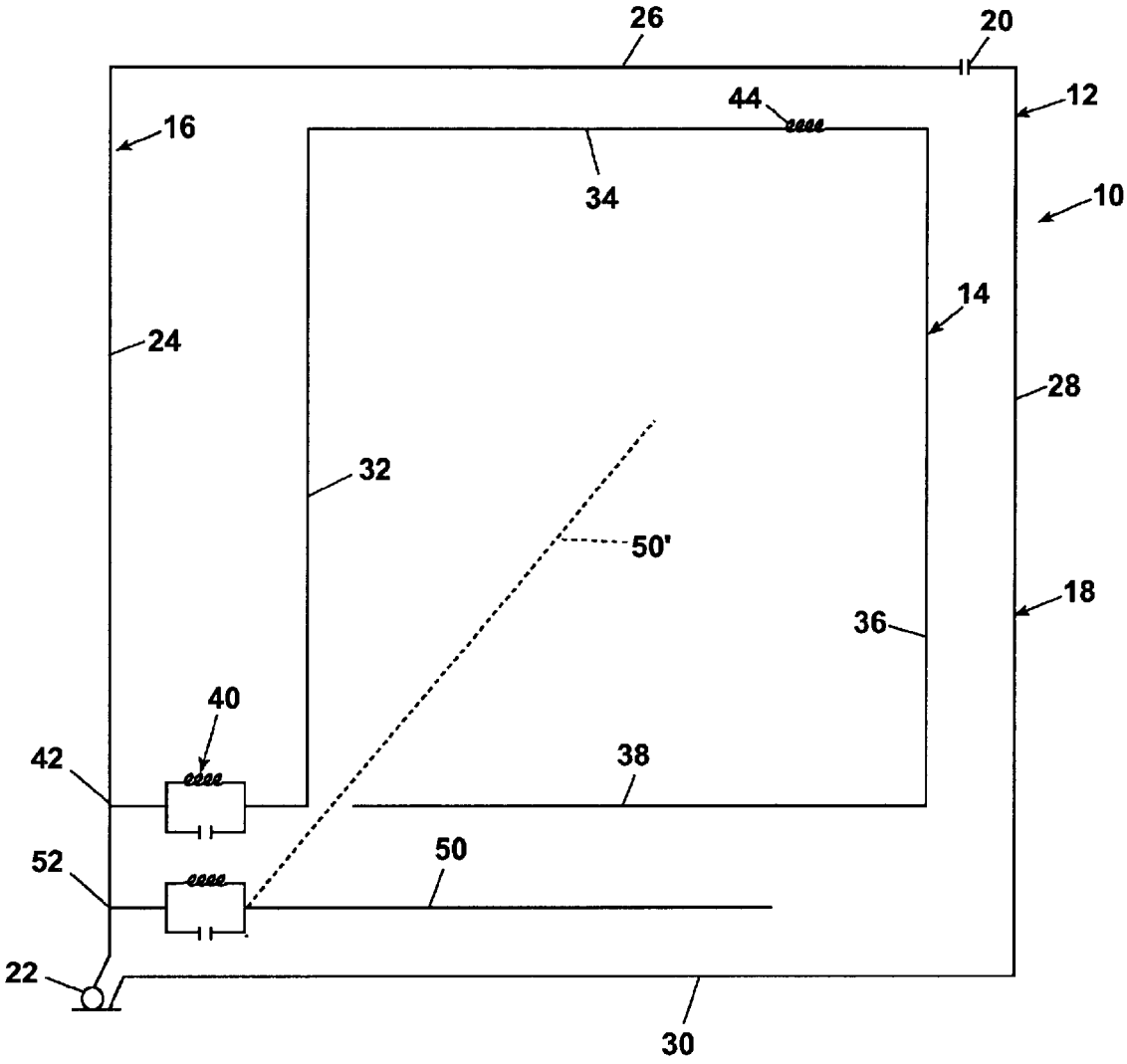
FIG. 3 is a plan schematic view of a third embodiment of an antenna arrangement according to the invention.

An enhancement to the invention is illustrated in FIG. 3. A weatherband probe 50 extends from the feed point 52 on the FM loop 12 and runs parallel to one of the segments 24 or 30. The length of the weatherband probe 50 is selected to resonate in the weatherband frequencies (162 MHz). The weatherband probe 50' can alternatively extend at an angle relative to the portion 24 as illustrated in phantom. The weatherband probe 50 can be isolated from the FM loop 12 and by using a resonant L-C circuit 54.

Figure 4:
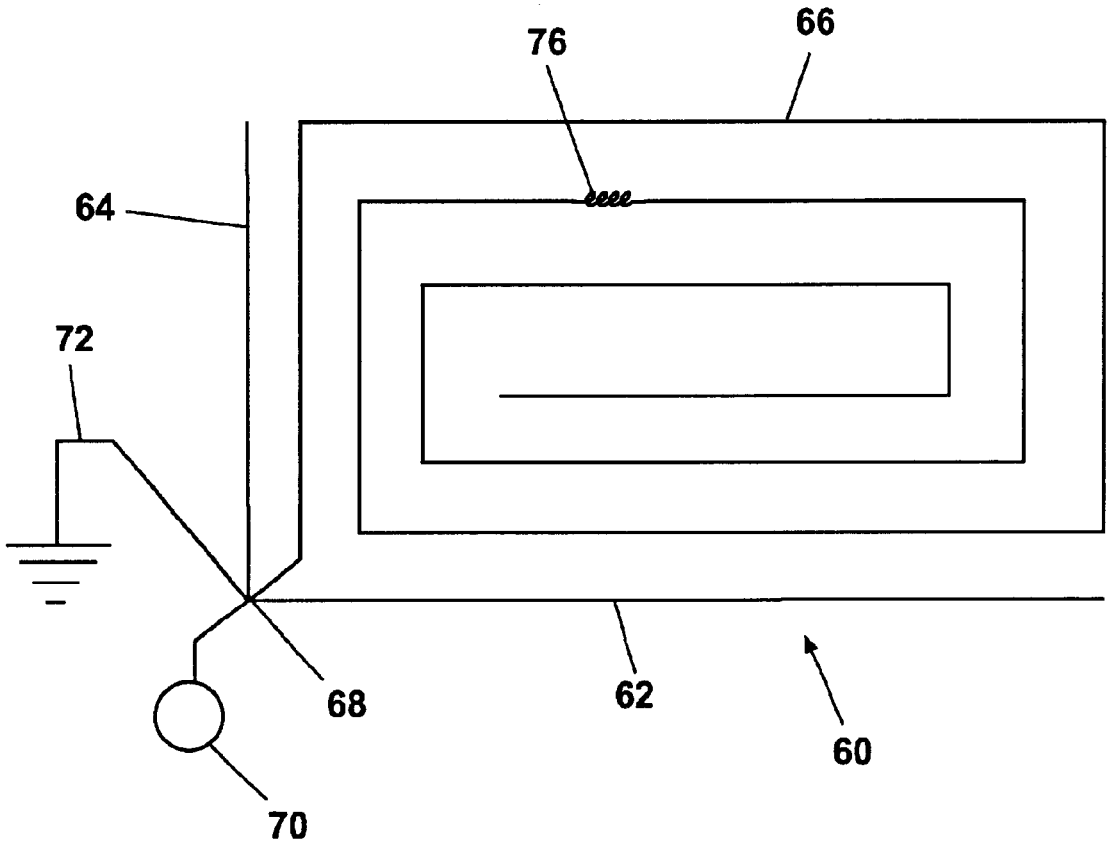
FIG. 4 is a plan schematic view of a fourth embodiment of an antenna arrangement according to the invention.

FIG. 4 illustrates an alternative embodiment of the invention that has been found to provide nearly omnidirectional reception in the AM/FM and WB frequencies. A flat antenna arrangement 60 comprises an FM probe 62, a WB probe 64 and an AM coiled probe 66. All three connect to a single feed point 68 that is adapted to connect to an antenna feed line 70 in a conventional manner. The FM probe 62 and WB probe 64 are disposed at 90 degrees with respect to each other, and intermediate the two probes 62, 64 is the AM coiled probe 66. The AM coiled probe 66 is a coil wherein each turn is preferably equidistantly spaced from another. Also, preferably, the probes 62, 64 are spaced from the AM coiled probe 66 the same distance as the turns of the coil are spaced from each other. Optionally, a ground connection 72 can be provided from the feed point 68 to improve performance as needed.

It has been found that with the antenna arrangement 60, interaction between the probes 62, 64 and the coiled probe 66 reduces the actual length of the components necessary to optimize reception in the respective frequency ranges. For example, good performance has been achieved where the FM probe 62 is 19 inches long, the WB probe 64 is 14 inches long, and the total length of the AM coiled probe 66 is 112 inches. It is noted that no single side of the AM coiled probe 66 is longer than an adjacent probe 62, 64.

Figure 5:
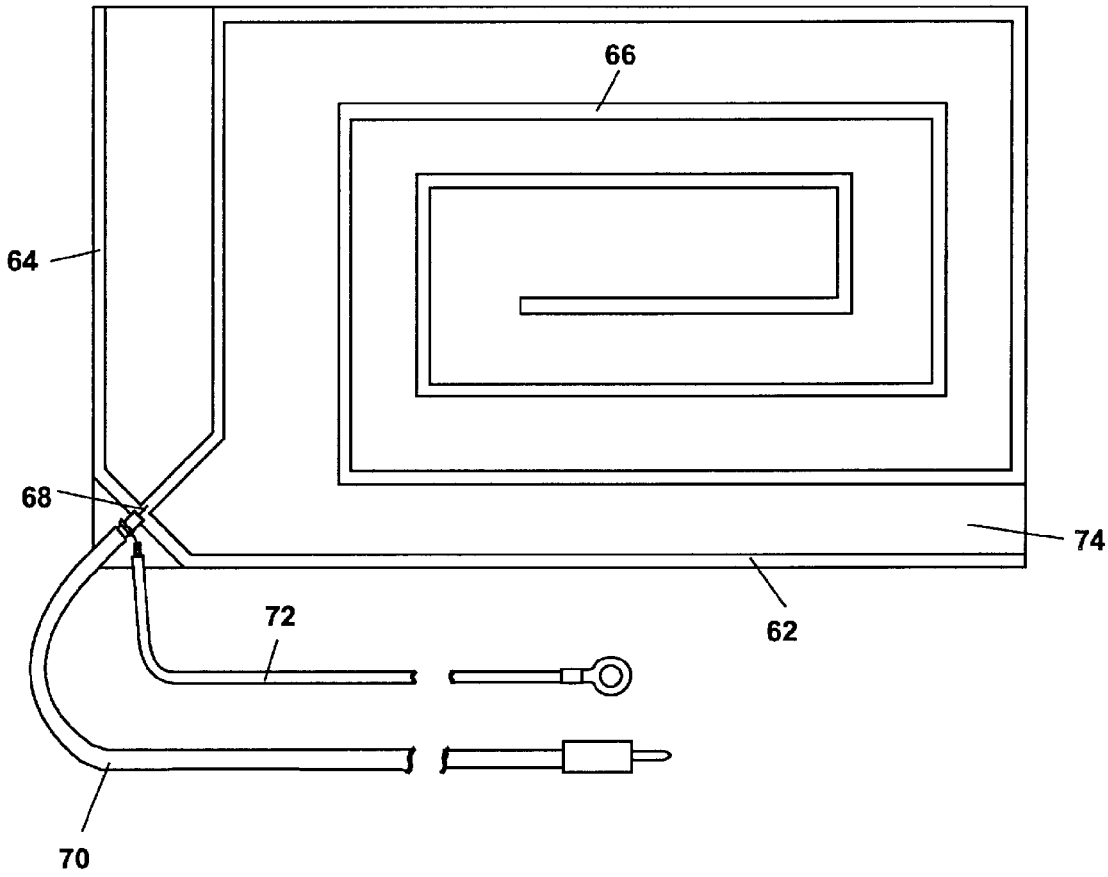
FIG. 5 is a plan view of a fifth embodiment of an antenna arrangement according to the invention.

As with the first embodiment, the actual construction of the arrangement 60 can take many different forms. One such embodiment is illustrated in FIG. 5. Typically the feed point 68 will be adapted to connect to a high impedance cable 70 (normally RG 62). With respect to the arrangement 10 itself, it is important only that the FM probe 62, the WB probe 64 and the AM coiled probe 66 be coplanar. Each can be formed of single wires mounted and held in place so as to be coplanar. In FIG. 5, the arrangement 60 is formed of wires or conductive ink on a dielectric substrate 74 to form a module. The ground connection 72 is a separate lead adapted to be connected to a ground source in conventional manner. It also is possible to weave wires into a web, or to sew wires onto a dielectric substrate, or to produce conductive traces on a printed circuit board. As well, an optional coil 76 can be added to the AM coiled probe 66 to electrically lengthen it and further enhance AM reception (see FIG. 4).

While the invention has been specifically described in connection with certain specific embodiments thereof, it is to be understood that this is by way of illustration and not of limitation, and the scope of the appended claims should be constructed as broadly as the prior art will permit.

What is claimed is:

1. An antenna arrangement for installation under a dielectric cover of a vehicle, comprising:

a first loop having first and second conductor sections of substantially equal length, and a capacitor, each conductor section having one end with an antenna feed line connector and the other end connected to one side of the capacitor, wherein the length of the first and second conductor sections is sufficient to resonate in the FM frequency range and wherein the capacitor has a predetermined value of capacitance to block frequencies in the AM range, and a probe, coplanar with the first loop, connected to the first section, and having sufficient length to effectively enhance AM reception from the first and second conductor sections.

2. An antenna arrangement according to claim 1 and further comprising an L-C circuit between the probe and the first section.

3. An antenna arrangement according to claim 2 wherein the first loop is square.

4. An antenna arrangement according to claim 3 wherein the probe comprises more than one segment.

5. An antenna arrangement according to claim 4 wherein the segments are normal to each other.

6. An antenna arrangement according to claim 5 wherein the probe comprises four segments.

7. An antenna arrangement according to claim 6 wherein each of the segments is parallel to a conductor section.

8. An antenna arrangement according to claim 7 and further comprising a second probe coplanar with the first loop, connected to the first conductor section and having a length sufficient to resonate at the weatherband frequency.

9. An antenna arrangement according to claim 8 and further comprising an L-C circuit between the second probe and the first conductor section.

10. An antenna arrangement according to claim 1 wherein the probe is connected to the first conductor section near the antenna feed line connector.

11. An antenna arrangement according to claim 10 and further comprising an L-C circuit between the probe and the first conductor section.

12. An antenna arrangement according to claim 11 wherein the first loop is square.

13. An antenna arrangement according to claim 12 wherein the probe comprises more than one segment.

14. An antenna arrangement according to claim 13 wherein the segments are normal to each other.

15. An antenna arrangement according to claim 14 wherein the probe comprises four segments.

16. An antenna arrangement according to claim 15 wherein each of the segments is parallel to a conductor section.

17. An antenna arrangement according to claim 16 and further comprising a second probe coplanar with the first loop, connected to the first section and having a length sufficient to resonate at the weatherband frequency.

18. An antenna arrangement according to claim 17 and further comprising an L-C circuit between the second probe and the first conductor section.

19. An antenna arrangement according to claim 1 wherein the probe is connected to the first conductor section near the capacitor.

20. An antenna module comprising:

a planar dielectric substrate;

a first loop mounted to the substrate and having first and second conductor sections of substantially equal length, and a capacitor, each conductor section having one end with an antenna feed line connector and the other end connected to one side of the capacitor, wherein the length of the first and second conductor sections is sufficient to resonate in the FM frequency range and wherein the capacitor has a predetermined value of capacitance to block frequencies in the AM range, and a probe, mounted to the substrate substantially coplanar with the first loop, connected to the first conductor section, and having sufficient length to effectively enhance AM reception from the first and second conductor sections.

21. An antenna module comprising:

a planar dielectric substrate;

a first probe mounted to the substrate;

a second probe mounted to the substrate normal to and shorter than the first probe; and a coiled probe mounted to the substrate coplanar with the first and second probes, and within the angle formed between the first and second probes, wherein the first and second probes and the coiled probe are each connected to a single feed point and the coiled probe comprises multiple turns, no turn extending beyond the length of either the first or second probes.

22. The antenna arrangement of claim 21 wherein each turn of the coiled probe and the first and second probes are equidistantly spaced from another of the turns of the coiled probe or the first and second probes.

23. The antenna arrangement of claim 21 and further comprising a ground lead connected to the feed point.

24. The antenna arrangement of claim 21 wherein the first probe has sufficient length to resonate in the FM frequency range, the second probe has sufficient length to resonate in the WB frequency range and the coiled probe has sufficient length to effectively function as an AM antenna.

25. The antenna arrangement of claim 24 wherein the length of each of the probes and the coiled probe is less than one quarter wavelength of its corresponding frequency midrange.

* * * * *